US011745239B2

(12) United States Patent
Vielhaber et al.

(10) Patent No.: US 11,745,239 B2
(45) Date of Patent: Sep. 5, 2023

(54) PROFILING STATION, PROFILING UNIT FORMED THEREFROM AND PROFILING SYSTEM

(71) Applicant: ASMAG-Holding GmbH, Gruenau im Almtal (AT)

(72) Inventors: Johann Vielhaber, Gruenau im Almtal (AT); Manfred Imberge, Dortmund (DE)

(73) Assignee: ASMAG-Holding GmbH, Gruenau im Almtal (AT)

( * ) Notice: Subject to any disclaimer, the term of this patent is extended or adjusted under 35 U.S.C. 154(b) by 184 days.

(21) Appl. No.: 17/285,953

(22) PCT Filed: Oct. 18, 2019

(86) PCT No.: PCT/AT2019/060347
§ 371 (c)(1),
(2) Date: May 7, 2021

(87) PCT Pub. No.: WO2020/077378
PCT Pub. Date: Apr. 23, 2020

(65) Prior Publication Data

US 2021/0387242 A1 Dec. 16, 2021

(30) Foreign Application Priority Data

Oct. 19, 2018 (AT) ..... A 50909/2018

(51) Int. Cl.
*B21D 5/08* (2006.01)
*B21C 37/08* (2006.01)

(52) U.S. Cl.
CPC ..... *B21C 37/0803* (2013.01); *B21D 5/083* (2013.01); *B21D 5/086* (2013.01)

(58) Field of Classification Search
CPC ..... B21D 5/08; B21D 5/083; B21D 5/086; B21D 5/10; B21D 5/12; B21C 37/0803
See application file for complete search history.

(56) References Cited

U.S. PATENT DOCUMENTS 3,903,723 A * 9/1975 Colbath ..... B21D 5/06 72/181
4,558,577 A 12/1985 Trishevsky et al.
(Continued)

FOREIGN PATENT DOCUMENTS

AT 408 318 B 10/2001
CA 2 322 669 A1 4/2002
(Continued)

OTHER PUBLICATIONS

English translation of the International Preliminary Report on Patentability and Written Opinion of the International Searching Authority in PCT/AT2019/060347, dated Feb. 5, 2021.
(Continued)

*Primary Examiner* — Debra M Sullivan
(74) *Attorney, Agent, or Firm* — Collard & Roe, P.C.

(57) ABSTRACT

A profiling station, a profiling unit formed therefrom and also a profiling installation continuously form a material strip into a profile. The profiling station includes a rack frame, a profiling arrangement with a forming roller and also a first and a second counter roller as well as a drive assembly. A first roller axis and a second roller axis of the counter rollers form between them a buckling angle, wherein the counter rollers define a bending edge for the material strip to be formed. The first counter roller and also the second counter roller are driven by the drive assembly in such a way that the first counter roller has a circumferential
(Continued)

speed at its outer circumference and the second counter roller has a circumferential speed at its outer circumference that are equal to one another.

14 Claims, 4 Drawing Sheets

(56) References Cited

U.S. PATENT DOCUMENTS

| | | | |
|---|---|---|---|
| 4,716,754 | A | 1/1988 | Youngs |
| 6,109,083 | A | 8/2000 | Steinmair |
| 2002/0104355 | A1 | 8/2002 | Patty |
| 2010/0263424 | A1 | 10/2010 | Madhavan et al. |
| 2017/0203350 | A1 | 7/2017 | Okada et al. |

FOREIGN PATENT DOCUMENTS

| | | | |
|---|---|---|---|
| EP | 1 914 020 | B1 | 4/2009 |
| JP | H04-9221 | A | 1/1992 |
| JP | H04-59101 | A | 2/1992 |
| JP | 2000-042640 | A | 2/2000 |

OTHER PUBLICATIONS

International Search Report of PCT/AT2019/060347, dated Feb. 25, 2020.

* cited by examiner

PROFILING STATION, PROFILING UNIT FORMED THEREFROM AND PROFILING SYSTEM

CROSS REFERENCE TO RELATED APPLICATIONS

This application is the National Stage of PCT/AT2019/060347 filed on Oct. 18, 2019, which claims priority under 35 U.S.C. § 119 of Austrian Application No. A 50909/2018 filed on Oct. 19, 2018, the disclosure of which is incorporated by reference. The international application under PCT article 21(2) was not published in English.

BACKGROUND OF THE INVENTION

1. Field of the Invention

The invention relates to a profiling station, a profiling unit each formed of two associated profiling stations, and also a profiling installation comprising multiple profiling stations and/or profiling units arranged in succession in a pass direction for the continuous forming of a material strip into a profile, in particular into a longitudinally welded profile with a rectangular cross-section.

2. Description of the Related Art

JP 2000 042640 A describes a forming unit for forming an elongated sheet metal part into a cross-sectional shape angled with respect thereto. The two legs of the sheet metal part are pressed, by means of cylindrical rollers with axes of rotation oriented at an angle to each other, against a central further roller with a double-frustum shape. In one exemplary embodiment, both cylindrical rollers are driven separately from each other by a common drive shaft of a common drive. The central roller with the double-frustum shape is also driven by the same drive motor via the common transmission. In a further described exemplary embodiment, each of the rollers is driven by its own drive motor.

From US 2017/203350 A1, a device and a method for forming oblong objects by means of cooperating rollers has become known, in which the roll formed object has a dimension varying in its width direction—namely in the direction of the height. The dimension varies continuously in the longitudinal direction of the roll formed component. To this end, multiple individual rollers arranged next to or on top of each other are provided in the transverse direction with respect to the longitudinal extension of the object.

U.S. Pat. No. 4,558,577 A describes a metal forming technology by means of a roll-forming device, which is configured for producing objects from a workpiece with varying cross-sectional dimensions in the longitudinal direction. The roll-profiling machine comprises a series of roll-profiling stands for forming a flat workpiece into the desired cross-sectional configuration. Moreover, a separate device for monitoring the positioning of the workpiece at the input side of the roll-profiling machine and a control unit for sending signals to each roll-profiling stand are provided, for effecting the transverse movement of the forming elements according to a predefined roll-profiling pattern. The roll-profiling stand can have either driven, contoured rolls or non-driven forming rolls. In each roll-profiling stand, roller pairs cooperating in each case are provided, which can be displaced together in the transverse direction with respect to the longitudinal extension of the workpiece to be formed.

JP H04 59101 A describes a forming unit for forming an elongated sheet metal part into a cross-sectional shape that is angled thereto. The two legs of the sheet metal part are pressed, according to FIG. 6, by means of cylindrical rollers with axes of rotation oriented at an angle to each other, against a central further roller with a double-frustum shape. Due to the two cylindrical rollers each resting on one of the legs, they rotate with the same circumferential speed relative to each other.

CA 2 322 669 A1 describes a retro-fit roller die apparatus for supporting pairs of roller dies in predetermined clearances for processing a web workpiece, and for varying the clearances between the dies to accommodate variations in the thickness of web material. To this end, each roller die pair comprises a first and a second roller die rotatably mounted on respective roller die bearings, wherein one of the first and second roller dies is moveable both upwardly and downwardly transversely to its axis of rotation and axially along its axis of rotation. Thereby, an adjusting of the die clearance between the first and the second roller die in two planes is achieved. The two adjustments can take place simultaneously so as to cause an adjustment in a diagonal direction between one of the roller dies and the other in each of the roller pairs.

EP 1 914 020 B1 describes a generically designed profiling stand for a roll forming machine with a first forming roller and a second forming roller, between which a material strip or profile to be formed is passed through. A free-running lateral roller cooperates with each of the two forming rollers located on both sides of the material strip, which are mounted as free-running rollers on the profiling stand and are designed without any drive-connection to a drive. In addition to the centrally arranged first forming roller, a third forming roller is provided, which is arranged opposite the second forming roller. The central first forming roller forms a first forming roller pair, together with the second forming roller, and a second forming roller pair with the third forming roller. Moreover, a second free-running lateral roller cooperates with the second forming roller pair. The two obliquely positioned forming rollers, which constitute the second and third forming roller, are each drive-connected to their own drive shaft. The first central forming roller located between the obliquely positioned forming rollers in turn is drive-connected with its own drive shaft. The profiling stand further comprises a rack, in which drive shafts for the forming rollers are mounted. The profiling stand present here is designed as a diagonal roller unit, i.e. The second and third forming rollers have rotational axes which are angled with respect to the axes of the related drive shafts. The disadvantage of this is that the drive speeds and the related circumferential speeds of the driven forming rollers were difficult to synchronize and the resulting therefrom, damages to the surface occurred.

From AT 408 318 B, a device for the continuous rolling of a sheet metal strip into a profile having straight profile legs in the cross-section is known. The device serves in particular to produce longitudinally welded rectangular tubes. Racks with forming rollers and counter rollers are arranged on carriers for gradually bending the sheet metal strip to be deformed, with the forming and counter rollers of the racks on the one side of the central plane and with the forming and counter rollers of the racks on the other side of the central plane into the desired profile. The counter rollers located below the sheet metal strip each have a cylindrical section and a frustum-shaped section adjoining in an axial direction, wherein both are arranged on a common shaft. The forming rollers are mounted in the respective racks so as to be freely rotatable, wherein the counter rollers are driven by a motor. A disadvantage here is that the circumferential speed of the frustum-shaped section, along its surface line, also increases with the increased diameter. This leads to damages to the surface of the sheet metal band to be formed.

SUMMARY OF THE INVENTION

The object of the present invention was to overcome the disadvantages of the prior art and to provide a profiling station a profiling unit each formed of two associated profiling stations and also a profiling installation comprising multiple profiling stations or profiling units arranged in succession in a pass direction for the continuous forming of a material strip into a profile, by means of which a user is able to perform a safe forming, even of profiles with high or large aspect ratio while ensuring a flawless surface quality in the forming region.

This object is achieved by a profiling station, a profiling unit comprising two profiling stations arranged in immediate succession and a profiling installation with multiple profiling stations arranged in immediate succession or multiple profiling units arranged in immediate succession, according to the claims.

The profiling station according to the invention serves for the continuous and permanent forming of a material strip into a profile, in particular into a longitudinally welded profile with a polygonal cross-section or an open cross-section. The material strip in turn has a first flat side and a second flat side arranged to be opposite the first flat side. The profiling station defines a longitudinal axis in the pass direction of the material strip and comprises

- a rack frame,
- a profiling arrangement with
  - at least one forming roller, which at least one forming roller can be turned toward the first flat side of the material strip,
  - a first counter roller, which first counter roller is cylindrically designed and defines a first roller axis and a first roller diameter,
  - a second counter roller, which second counter roller is cylindrically designed and defines a second roller axis and a second roller diameter,
  - wherein the first counter roller and the second counter roller form a counter roller pair, and the counter roller pair can be turned toward the second flat side of the material strip, and wherein the first roller axis and the second roller axis enclose a buckling angle between them, and
  - wherein the counter rollers of the counter roller pair define between them a bending edge for the material strip to be formed,
- a drive assembly with at least one drive unit, wherein at least one of the counter rollers of the counter roller pair is drive-connected to the at least one drive unit,
- and wherein the profiling arrangement and possibly the drive assembly are held on the rack frame, and in this regard,
- a mechanical rotation transmission device is provided between the first counter roller and the second counter roller, and that counter roller, which is drive-connected to the first drive unit, transmits the drive torque to the other counter roller by means of the rotation transmission device,
- the mechanical rotation transmission device comprises a cardan joint or a jointed shaft, and
- the first counter roller and also the second counter roller are driven by the drive assembly and by means of the mechanical rotation transmission device such that the first counter roller at its outer circumference and the second counter roller at its outer circumference each have a circumferential speed that is equal to the other.

The advantage obtained thereby is that due to both counter rollers being driven simultaneously, a safe and especially low-slip further transport through the individual profiling stations of the profiling installation is achieved for the material strip and/or sheet metal strip to be formed. Because the two counter rollers each have a cylindrical outer shape, on which the flat side of the material strip to be formed abuts in each case, no unwanted relative movement between the material strip and the counter roller arranged at an angle to one another occurs due to the selection of the same circumferential speed. During the passing movement, the material strip to be formed is pressed, by the forming roller, into the bending edge defined by the counter rollers of the counter roller pair and is thus pressed onto the counter rollers arranged at an angle to one another. In this regard, the forming roller is preferably oriented in the bisectrix between the first roller axis and the second roller axis of the two counter rollers, whereby the pressing force is also divided into to force components. As now both counter rollers are driven with the same circumferential speed at their outer circumference, a more effective forming process and a gentle further transport of the material strip to be formed in each of the profiling stations arranged in succession is achieved. Thus, the surface damage on the flat side of the material strip is avoided by different circumferential speeds of the counter rollers.

In the two profiling stations designed according to the invention, in each case, one mechanical rotation transmission device is provided between the first counter roller and the second counter roller. That counter roller, which is drive-connected to the first drive unit, transmits the drive torque to the other counter roller by means of the mechanical rotation transmission device. Thus, an exactly defined drive speed is safely transmitted mechanically from the driven counter roller to the further counter roller cooperating therewith. This ensures a low-slip to nearly no-slip synchronization between the counter rollers being drive-connected to one another.

Here, the mechanical rotation transmission device comprises a cardan joint. Choosing the cardan joint thus makes it even easier to enable adjustments of the angulation of the two roller axes relative to each other. Moreover, however, this also allows resorting to inexpensive standard parts for transmitting the drive torque.

An alternative embodiment of the mechanical rotation transmission device provides that it comprises a jointed shaft. Choosing a jointed shaft as a mechanical rotation transmission device thus allows an additional length compensation and an adjustment to different application conditions to be performed easily.

The further profiling station according to the invention also serves for the continuous and permanent forming of a material strip into a profile, in particular into a longitudinally welded profile with a polygonal cross-section or an open cross-section. The profiling station defines a longitudinal axis in the pass direction of the material strip and comprises

- a rack frame,
- a profiling arrangement with
  - at least one forming roller, which at least one forming roller can be turned toward the first flat side of the material strip, a first counter roller, which first counter roller is cylindrically designed and defines a first roller axis and a first roller diameter, a second counter roller, which second counter roller is cylindrically designed and defines a second roller axis and a second roller diameter, wherein the first counter roller and the second counter roller form a counter roller pair, and the counter roller pair can be turned toward the second flat side of the material strip, and wherein the first roller axis and the second roller axis enclose a buckling angle between them, and wherein the counter rollers of the counter roller pair define between them a bending edge for the material strip to be formed, a drive assembly with at least one drive unit, wherein at least one of the counter rollers of the counter roller pair is drive-connected to the at least one drive unit, and wherein the profiling arrangement and possibly the drive assembly are held on the rack frame, and in this regard, a mechanical rotation transmission device is provided between the first counter roller and the second counter roller, and that counter roller, which is drive-connected to the first drive unit, transmits the drive torque to the other counter roller by means of the rotation transmission device, the mechanical rotation transmission device comprises a cardan joint or a jointed shaft, and the first counter roller and also the second counter roller are driven by the drive assembly and by means of the mechanical rotation transmission device such that the first counter roller at its outer circumference and the second counter roller at its outer circumference each have a circumferential speed that is equal to the other.

In this profiling station designed according to the invention, the mechanical rotation transmission device comprises a bevel gear arrangement having a first bevel gear wheel and a second bevel gear wheel. Choosing a bevel gear arrangement thus allows always ensuring a perfect, mechanics-based drive torque transmission depending on the enclosed buckling angle between the two roller axes of the counter rollers. Moreover, however, it is also possible to carry out adaptations and adjustments of the enclosed buckling angle in within certain boundaries.

An alternative embodiment of the mechanical rotation transmission device provides that it comprises an angular gearbox. If an angular gearbox is used between the two cooperating counter rollers, a safe, mechanical transmission of the drive torque is thus also be achieved. The angular gearbox can be used in particular when the two roller axes enclose approximately a right angle relative to each other. Furthermore, however, a speed increase or speed reduction of the drive speed can also take place within certain boundaries, whereby the use of different roller diameters is also made possible.

Moreover, it may be advantageous if the first roller diameter of the first counter roller and the second roller diameter of the second counter roller are designed to be the same size. If the two roller diameters of the counter rollers are selected to be the same size, they can be driven with the same drive speed. This makes it possible to provide a mechanical, force-fitting transfer device between the two counter rollers, in order to thus be able to safely transmit the drive torque of the driven counter roller to the further counter roller.

A further preferred embodiment is characterized in that the drive assembly comprises a further drive unit, and the at least one forming roller is drive-connected to the further drive unit. Thus, an additional propelling force can be applied to the material strip to be formed. However, in this regard, equal circumferential speeds with respect to the circumferential speeds of the counter rollers are also to be paid attention to and/or taken into consideration.

Moreover, it may be advantageous if a guide assembly is provided, by means of which guide assembly the at least one forming roller is guided so as to be displaceable on the rack frame. Hence, an adjustment to different gauges and/or thicknesses of the respective material strip to be formed can be carried out. Thus, the gap width between the forming roller and the oppositely arranged counter rollers can be adjusted and set.

A different alternative embodiment is distinguished by the fact that the first roller axis and second roller axis of the counter rollers of a counter roller pair are arranged in a common plane, and the common plane is arranged in a normal orientation with respect to the longitudinal axis. This allows achieving an even better orientation with respect to the bending edge defined by the cooperating counter rollers.

A further preferred embodiment is characterized in that the first roller axis of the first counter roller is arranged in a first plane, and the second roller axis of the second counter roller of a counter roller pair is arranged in a second plane, and that the two planes are arranged so as to be parallel and offset from each other. This embodiment helps achieve an even more individual adjustment to different forming conditions.

The invention further also comprises a profiling unit for the continuous, permanent forming of a material strip into a profile, in which two profiling stations arranged in immediate succession and configured according to the invention are provided. Thus, a symmetrical forming of the parts or portions, located at both sides of the central plane, of the material strip to be formed can be achieved. Moreover, however, it is thereby also possible to create a modular system for building the profiling installation.

A further possible and possibly alternative embodiment has the features that a base frame is provided, and the two profiling station arranged in immediate succession are arranged and held on the base frame. Choosing a common base frame for two profiling stations each can thus additionally facilitate and improve the flexibility of the entire profiling installation as well as its mutual orientation and coordination.

A further embodiment provides that the profiling stations arranged in immediate succession are arranged opposite each other, with respect to a central plane running in a parallel direction with respect to the longitudinal axis and offset from each other. Thus, as a result of the opposite arrangement of the profiling stations, a forming step can be carried out in each of the same. The additional arrangement offset in the direction of the longitudinal axis can thus enable an even more flexible application of the profiling installation with a variety of widths of the material strip.

Another embodiment is distinguished by the fact that the profiling stations arranged in immediate succession are arranged in a mirror-imaged manner, with respect to a central plane running in a parallel direction with respect to the longitudinal axis. Due to the mirror-imaged arrangement, a symmetrical forming process can be achieved for each of the profiling units.

A further preferred embodiment is characterized in that the profiling stations arranged in immediate succession are guided on the base frame so as to be displaceable in the normal direction with respect to the longitudinal axis, in particular in the normal direction with respect to the central plane. Thus, an adjustment of the required processing width to the respective width of the material strip can be carried out.

The invention further also comprises a profiling installation for the continuous, permanent forming of a material strip into a profile, in which multiple profiling stations arranged in immediate succession in the direction of a longitudinal axis and configured according to the invention are provided.

The advantage achieved thereby is that by the multi-arrangement of multiple profiling stations in succession, a quick and safe further transport of the material strip to be formed can be achieved. However, this also causes a higher drive force for the forward movement to be applied to the material strip.

Moreover, it may be advantageous if in each case, two profiling stations configured according to the invention each form multiple profiling units of the profiling installation configured according to the invention. Thus, one symmetrical forming process can be made possible per profiling unit.

BRIEF DESCRIPTION OF THE DRAWINGS

For the purpose of better understanding of the invention, it will be elucidated in more detail by means of the figures below.

These show in a respectively very simplified schematic representation.

DETAILED DESCRIPTION OF PREFERRED EMBODIMENTS

First of all, it is to be noted that in the different embodiments described, equal parts are provided with equal reference numbers and/or equal component designations, where the disclosures contained in the entire description may be analogously transferred to equal parts with equal reference numbers and/or equal component designations. Moreover, the specifications of location, such as at the top, at the bottom, at the side, chosen in the description refer to the directly described and depicted figure and in case of a change of position, these specifications of location are to be analogously transferred to the new position.

The term "in particular" shall henceforth be understood to mean that it may refer to a possible more specific formation or more detailed specification of an object or a process step, but need not necessarily depict a mandatory, preferred embodiment of same or a mandatory practice.

Figure 1:
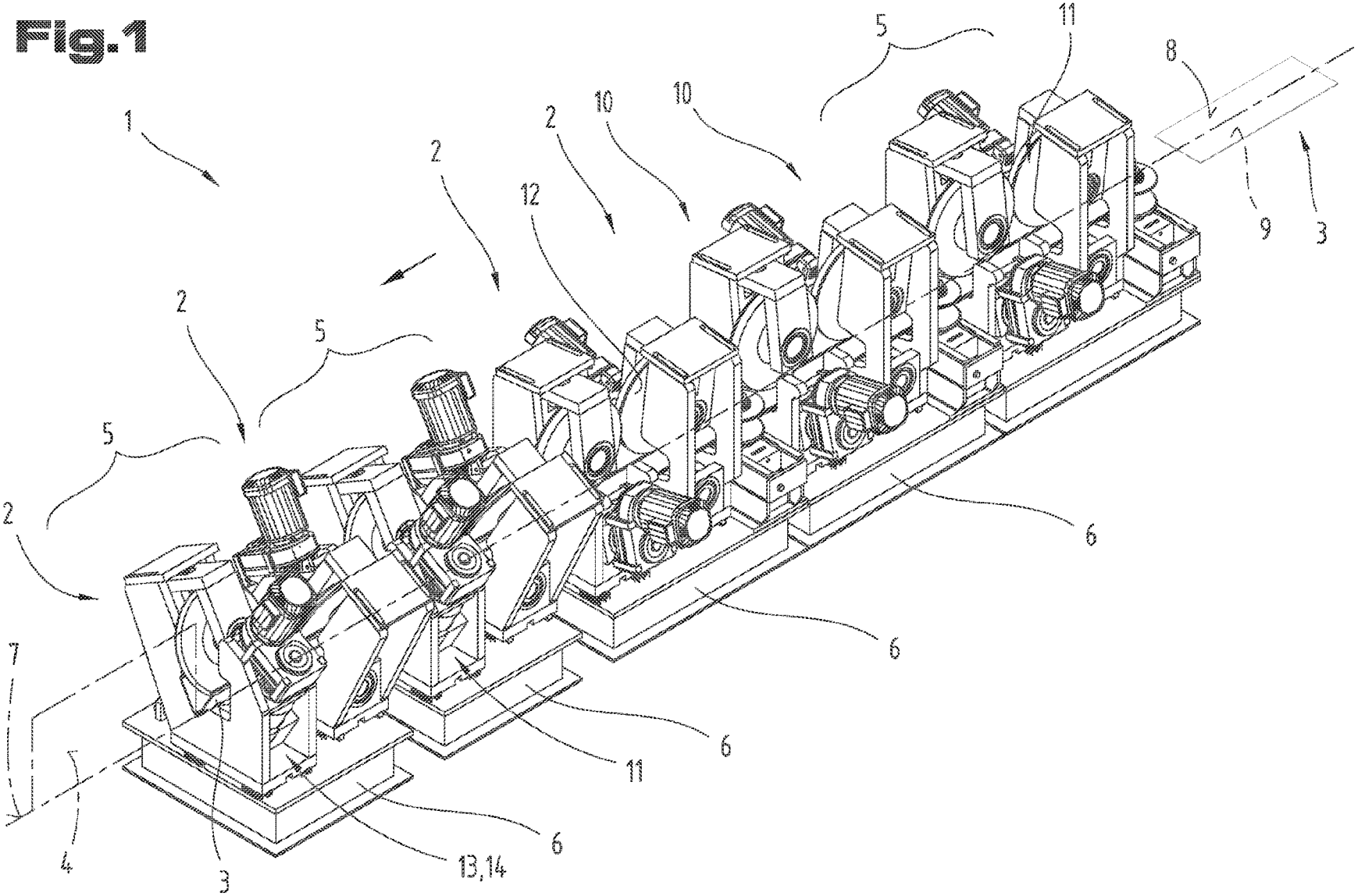
FIG. 1 a graphic representation of a profiling installation with multiple profiling stations arranged in succession.

FIG. 1 shows in further detail and describes a profiling installation 1 and the following FIGS. 2 to 5 show in further detail and describe various details of the profiling installation 1, in particular their profiling stations 2.

The profiling installation 1 serves to permanently form a material strip 3, which may also be referred to as a sheet metal strip or sheet metal band, in multiple profiling stations 2 arranged in immediate succession into a profile with a polygonal cross-section, by means of a continuous forming process. A polygonal cross-section may be e.g. a triangular cross-section, a square cross-section, a rectangular cross-section, a hexagonal cross-section, or an octagonal cross-section. Generally, such cross-sections having multiple straight line segments may also be referred to as polygonal cross-sections. In this regard, it should be noted that cross-sections which are open via their circumference, such as L-profiles, U-profiles, C-profiles, Z-profiles or the like may be made out of the material strip 3 by means of forming.

The forming process takes place by means of so-called roll-profiling, also referred to as roll-forming or cold rolling of profiles. In roll-profiling, most commonly, an originally flat material strip 3, in particular a sheet metal strip, which may be formed of various materials, is guided through multiple cooperating rolls or rollers arranged modularly and in succession, and thereby keeps being formed further until the final cross-sectional shape is reached. The forming process is carried out such that a permanent deformation of the formed material is permanently maintained. The aspect ratio of the rectangular profile may be at least 1:3 in its cross-section. However, rectangular profiles having an aspect ratio of up to 1:6 or more shall also be able to be formed thereby. This example shows that, in this regard, the shorter side of the rectangular profile may be that side on which the longitudinal weld seam is also formed. The longitudinal weld seam may also be arranged and formed at a cross-sectional location deviating therefrom or even in a corner or angle region of the profile.

It is preferred that in this profiling installation 1, a profile, particularly a polygonal profile or an open profile, is formed out of the mostly flat material strip 3, in particular made of a metallic material. As metallic materials, ferrous materials or non-ferrous metals may be formed. For producing longitudinally welded tubes, in particular rectangular tubes or square tubes, the flat sheet metal strip and/or the material strip 3 is preferably or predominantly formed symmetrically to a central plane 4 running in the longitudinal direction of the strip, such that the tube wall formed by the central strip of the material strip 3 is opposite the weld seam to be formed or already formed. The tube wall having the weld seam is therefore composed of two angled marginal webs of the material strip 3, which are first bent up from the flat material strip 3. However, an asymmetrical forming of the material strip 3 with respect to the central plane 4 would also be possible and may be applicable to some cross-sectional shapes.

The profiling installation 1 comprises multiple profiling stations 2 which are arranged in immediate succession in the pass direction of the material strip 3. The pass direction is adumbrated with an arrow above the profiling installation 1. Moreover, two profiling stations 2 at a time, which are arranged in immediate succession, can form an associated profiling unit 5. Therefore, the profiling station 2 are always arranged in pairs. Each of the profiling units 5 can be arranged and held at or on its own base frame 6. Each of the profiling stations 2 moreover defines a longitudinal axis 7 running in the passage direction of the material strip 3 and oriented in parallel thereto. The longitudinal axis 7 and the central plane 4 run in parallel to one another, wherein the central plane 4 preferably forms a vertical plane.

The profiling stations 2 arranged in immediate succession are arranged so as to be opposite one another with respect to the central plane 4, which runs in the parallel direction with respect to the longitudinal axis 7, and thus offset from each other. This means that the first profiling station 2 is arranged at one side of the central plane 4 and the second profiling station 2 is arranged is arranged at the opposite side of the central plane 4. In order to have a sufficient width available transversely or orthogonally with respect to the central plane 4 in each profiling station 2, profiling stations 2 arranged in immediate succession are arranged so as to be offset from each other in the direction of the longitudinal axis 7 and not directly opposite one another.

Preferably, the profiling stations 2 arranged in immediate succession may additionally be arranged so as to mirror each other with respect to the central plane 4. This allows always using structurally identical profiling stations 2 in a profiling unit 5, wherein, however, the arrangement that is offset from each other in the longitudinal direction of the longitudinal axis 7 takes place.

In order to be able to produce different scales and/or dimensions in profile cross-sections, material strips 3 with different initial widths are required. For adapting and adjusting the forming width, the profiling stations 2 arranged in immediate succession are guided on the base frame 6 so as to be displaceable in the normal direction with respect to the longitudinal axis 7. This takes place in particular in the normal direction with respect to the central plane 4.

When the material strip 3 passes through the profiling units 5, each of them preferably carries out a symmetrical forming step with respect to the central plane 4. With the progressing passage of the material strip 3 through the profiling installation 1, the material strip 3 approximates the cross-sectional shape to be produced until it is reached. The joining (welding) of the ends of the bent-up legs into a closed profile cross-section is carried out either at the end of the profiling installation 1 or in a further, separate welding installation provided therefor.

Figure 2:
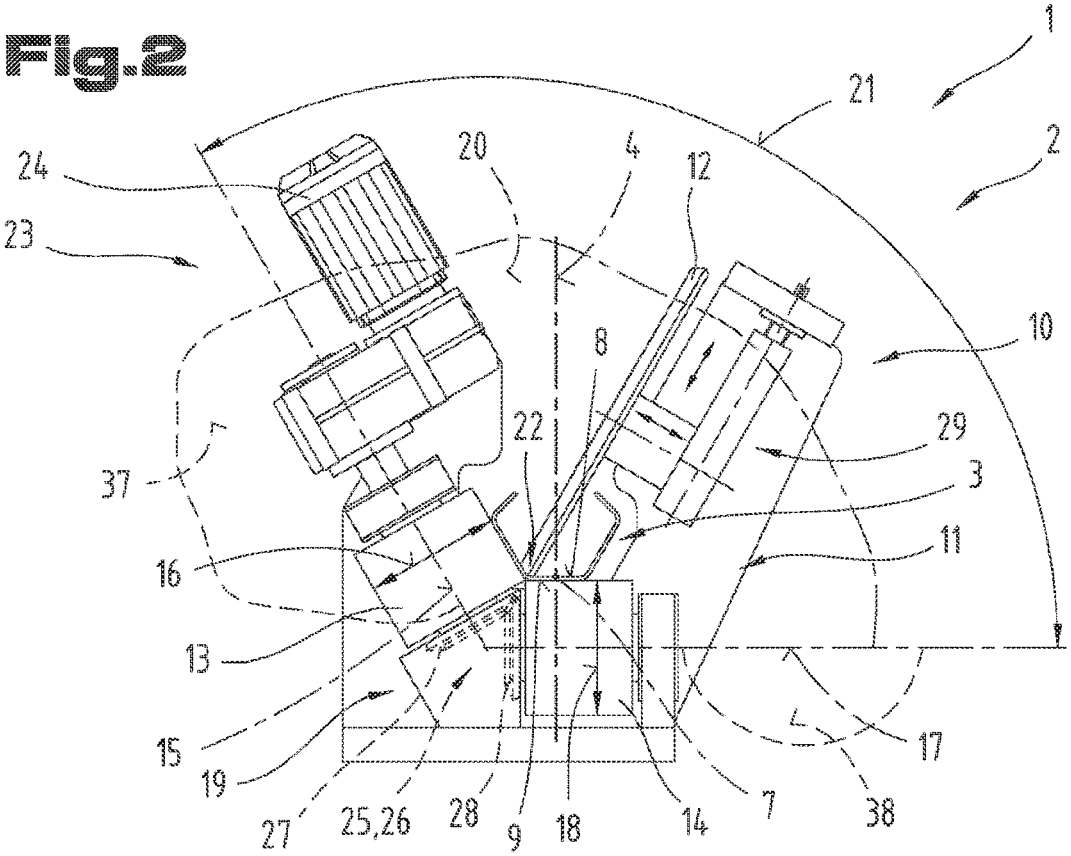
FIG. 2 a first possible embodiment of a rotation transmission device between the counter roller pair of the profiling arrangement, which is configured as a bevel gear arrangement, in a view.

FIG. 2 shows and describes in more detail a first possible and possibly independent embodiment of a profiling station 2.

The material strip 3 to be formed is formed by a strip or a longitudinal band and has a first flat side 8 or a first surface and a second flat side 9 which is arranged so as to be opposite the first flat side 8. With progression of the forming, the flat sides 8, 9 are divided in mostly multiple partial flat sides arranged next to each other and/or the material strip 3 is divided into multiple partial longitudinal bands.

The profiling station 2 in turn comprises a rack frame 10 shown in a simplified manner, which serves to accommodate and hold a profiling arrangement 11. In the following description of the profiling arrangement 11, its cooperating rollers or rolls and their drive are described by way of example. The profiling arrangement 11 serves to form the material strip 3 during the continuous passage by means of the rollers or rolls. As already described above, each of the profiling stations 2 defines the longitudinal axis 7 in the pass direction of the material strip 3. The central plane 4 preferably extends in the longitudinal axis 7, wherein the central plane 4 preferably also extends in the middle of the profile cross-section.

Here, the profiling arrangement 11 comprises at least one forming roller 12, which faces the first flat side 8—in this case the upper side—of the material strip 3. The at least one forming roller 12 serves to press the material strip 3 against a first counter roller 13 and a second counter roller 14 during the passage, as is generally known. For passing the material strip 3 through the profiling arrangement 11, a gap between the at least one forming roller 12 and the two counter rollers 13, 14, which gap corresponds to the gauge and/or thickness of the material strip 3 to be formed, is to be developed.

The first counter roller 13 is designed cylindrically and is rotatable about a first roller axis 15 and/or defines it. Moreover, the first counter roller 13 has a first roller diameter 16. The second counter roller 14 is also designed cylindrically and is in turn rotatable about a second roller axis 17 and/or defines it. The second roller diameter 18 of the second counter roller 14 corresponds, in its dimension, to the dimension of the first roller diameter 16 of the first counter roller 13. Therefore, in this exemplary embodiment, the two counter rollers 13, 14 are designed to have the same size with respect to their diameter. Moreover, the two counter rollers 13, 14 form a counter roller pair 19 and they face the second flat side 9—in this case the underside—of the material strip 3. The first roller axis 15 and the second roller axis 17 may be arranged so as to run in a common plane 20. The two roller axes 15 and 17 form between them a buckling angle 21. Moreover, the two roller axes 15 and 17 may be arranged so as to cut one another and/or intersect. The roller diameters 16 and 18 may also be different from each other, as will be described below.

However, it would also be possible to arrange the first roller axis 15 of the first counter roller 13 in a first plane 37 and to arrange the second roller axis 17 of the second counter roller 14 of a counter roller pair 19 in a second plane 38. The two planes 37 and 38 are preferably arranged so as to be parallel and offset from one another. The offset may be in the direction of the longitudinal axis 7, wherein the two planes 37 and 38 may also be arranged in a normal orientation with respect to the longitudinal axis 7. The two planes 37 and 38 are adumbrated in a simplified manner using dashed lines, wherein one of the two planes 37 or 38 may also form the previously described common plane 20. The offset arrangement of the two planes 37 and 38 relative to each other may also be selected for the exemplary embodiments described below.

At the start of the forming process, the enclosed buckling angle 21 is an obtuse angle and, in the case of a rectangular profile to be produced, approximates the right angle (90°) with progressing passage. Due to the elastic rebound of the material strip 3, the enclosed buckling angle 21 may also be slightly less than 90°. Moreover, outer enveloping surfaces of the counter rollers 13, 14, viewed in an axial section, define a bending edge 22 for the material strip 3.

Another essential factor in this exemplary embodiment and also in the further possible exemplary embodiments described below is that the counter rollers 13, 14 are each driven on their outer circumference, on which, in each case, the material strip 3 rests or is supported, such that they have the same circumferential speed relative to one another.

Here, the profiling station 2 additionally comprises a drive assembly 23 for rotationally driving at least one of the counter rollers 13, 14 of the counter roller pair 19. This way, the drive assembly 23 may comprise at least a first drive unit 24, which, in this exemplary embodiment, is drive-connected to the first counter roller 13. The first drive 24 and/or also the drive units described below may preferably be driven by and/or supplied with electric energy, wherein they also may be configured as gear motors or the like. Here, the term drive unit is understood to be any device or machine, which is designed for applying a rotational movement for driving the counter rollers 13, 14. In this regard, this may mean motors or other engines which are supplied with or driven by various drive means or energy sources. Possible bearing point and drive shafts for the counter rollers 13, 14 are not described in more detail as this falls under general expertise and can be freely selected. The profiling arrangement 11 as well as possibly also the drive assembly 23 are either held directly and/or indirectly on the rack frame 10 or accommodated therein. It should be noted that the first drive unit 24 does not have to be drive-connected to the first counter roller 13 as shown in this exemplary embodiment, but can be directly drive-connected to only the second counter roller 14. This may also be the case in the exemplary embodiments described below.

If, as shown here, the two counter rollers 13, 14 have the same roller diameter 16, 18, the same rotational frequency (same number of rotations within the same time unit) is to be selected for each of the counter rollers 13, 14.

Here, only the first counter roller 13 is driven and/or is drive-connected to the first drive unit 24. In order to be able to transmit the rotational movement and thus also the torque from the first counter roller 13 to the second counter roller 14, a mechanical rotation transmission device 25 is provided for that purpose, which is therefore arranged between the first counter roller 13 and the second counter roller 14. Thus, the drive torque can be transmitted originating from the first drive unit 24 to the first counter roller 13, from there to the mechanical rotation transmission device 25 and further on to the second counter roller 14. This way, a synchronous and low-slip to nearly no-slip drive of both counter rollers 13, 14 with the same circumferential speed is achieved.

The mechanical rotation transmission device 25 may be designed in a variety of ways, wherein in this exemplary embodiment, a bevel gear arrangement 26 having a first bevel gear wheel 27 and a second bevel gear wheel 28 meshing with the first is provided. Each of the bevel gears 27, 28 is arranged or formed on the corresponding counter roller 13, 14 in particular fastened thereon. The respective fastenings are not further described for the sake of clarity.

A guide assembly 29 may be provided around the previously described gap width for passing the material strip 3 through the cooperating rollers of the profiling arrangement 11. Preferably, the counter rollers 13, 14 of the counter roller pair 19 are arranged and held fixed in place with respect to and on the rack frame 10. By means of the guide assembly 29 the at least one forming roller 12 is displaceably guided on the rack frame 10. An additional locking device and/or clamping device may be provided for determining the set position of the forming roller 12.

The previously described plane 20, in which the two roller axes 15, 17 run so as to intersect, is preferably arranged or oriented in a normal orientation with respect to the longitudinal axis 7.

Figure 3:
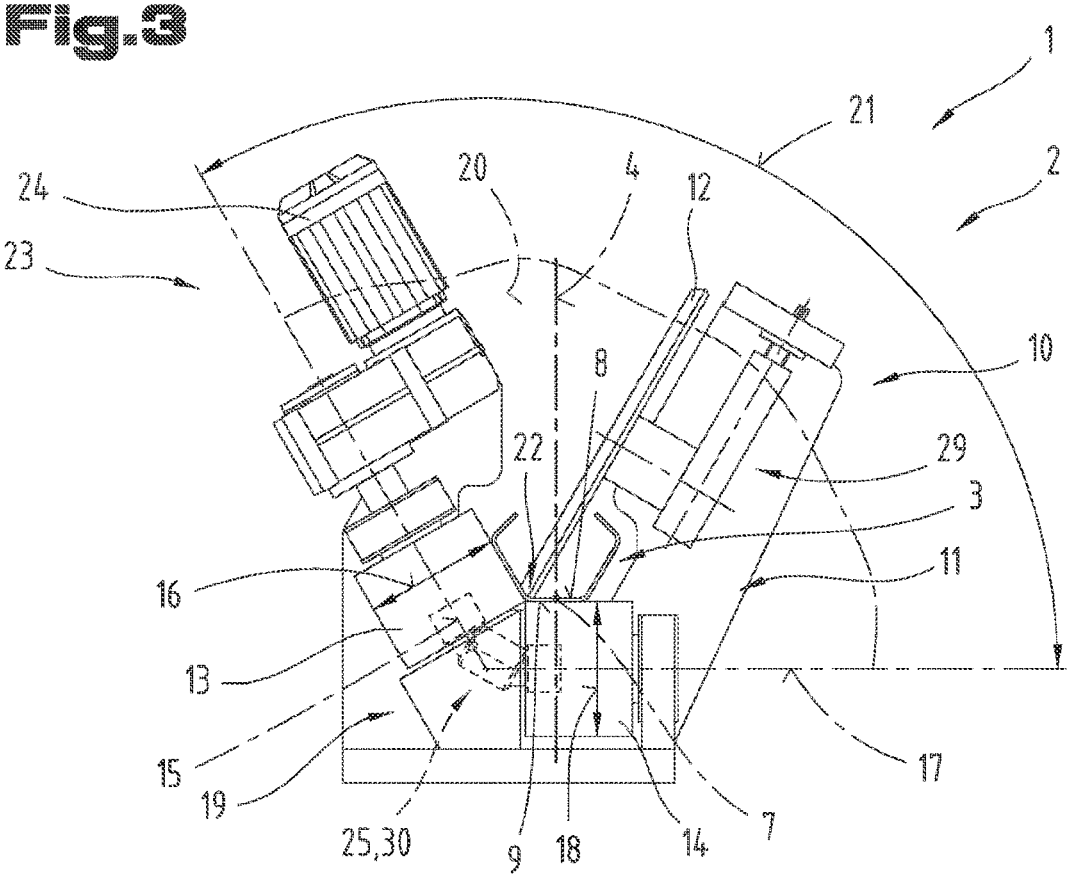
FIG. 3 a further embodiment of the rotation transmission device between the counter roller pair and the profiling arrangement, which is configured as a cardan joint, in a view.

FIG. 3 shows a further possible embodiment of the profiling station 2, wherein again, equal reference numbers and/or component designations are used for equal parts as before in FIGS. 1 and 2. In order to avoid unnecessary repetitions, it is pointed to/reference is made to the detailed description in FIGS. 1 and 2 preceding it.

The general structure corresponds to that which has been described in the two FIGS. 1 and 2. Here, merely a different embodiment of the mechanical rotation transmission device 25 was chosen.

Thus, it is provided here that instead of the previously described bevel gear 26, the drive torque is transferred from the driven first counter roller 13 to the second counter roller 14 by means of a cardan joint 30.

Instead of the cardan joint 30, which may also be referred to as universal joint, however, a jointed shaft, which is not further illustrated, could be used for transmitting the drive torque.

Figure 4:
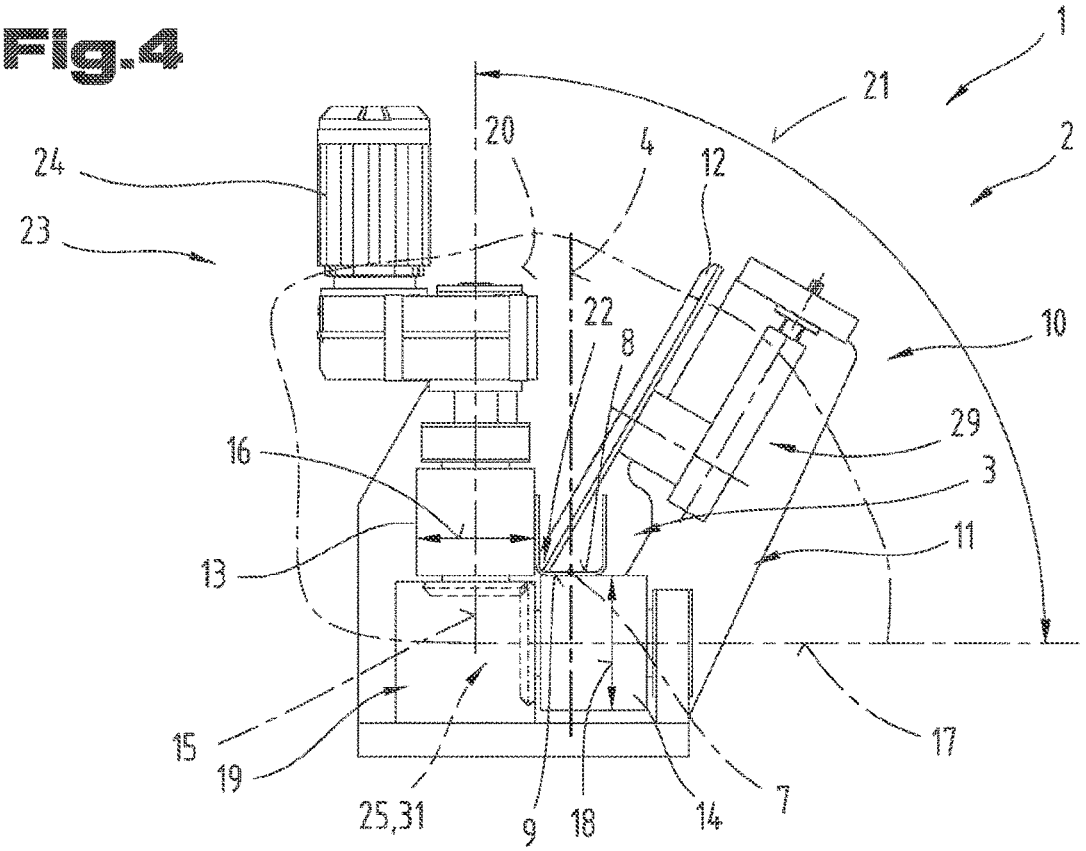
FIG. 4 a possible further embodiment of the rotation transmission device between the counter roller pair of the profiling arrangement, which is configured as an angular gearbox, in a view.

FIG. 4 shows a further possible embodiment of the profiling station 2, wherein again, equal reference numbers and/or component designations are used for equal parts as before in FIGS. 1 and 2. In order to avoid unnecessary repetitions, it is pointed to/reference is made to the detailed description in FIGS. 1 and 2 preceding it.

The general structure corresponds to that which has been described in the two FIGS. 1 and 2. Here, merely a different embodiment of the mechanical rotation transmission device 25 was chosen.

Thus, it is provided here that, instead of the bevel gear 26 previously described in FIG. 2, the torque is transmitted from the first counter roller 13 to the second counter roller 14 of the counter roller pair 19 by means of an angular gearbox 31. This applies particularly when the two roller axes 15, 17 enclose a right angle.

With the angular gearbox 31, it would also be possible for a speed reduction or speed increase of the rotational frequency from the driven counter roller 13, 14 to the further counter roller 14, 13 to take place between the counter rollers 13, 14. This applies particularly when roller diameters 16, 18 that are different from each other are used.

Figure 5:
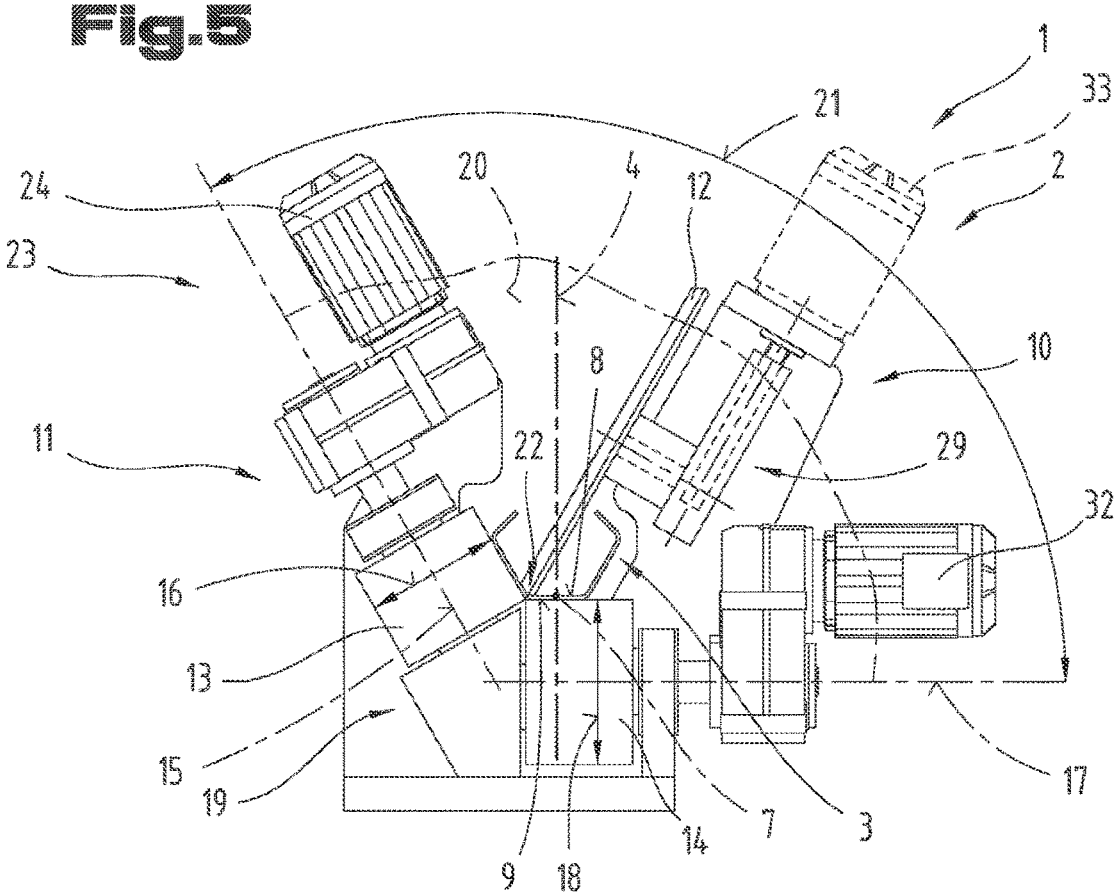
FIG. 5 a different drive arrangement for the counter rollers of the counter roller pair, which, however is not covered by the scope of protection, in which each counter roller is drive-connected to its own drive unit, in a view.

FIG. 5 shows a further possible exemplary embodiment, in which the two counter rollers 13, 14 are each drive-connected to their own drive means. In this regard, the mechanical rotation transmission device 25 as previously described in FIGS. 2 to 4 is dispensed with.

Additionally, the drive assembly 23 also comprises a second drive unit 32 in addition to the first drive unit 24. The first counter roller 13 is drive-connected to the first drive unit 24, wherein the second counter roller 14 is drive-connected to the second drive unit 32.

In this embodiment, it is not obligatorily required to design the counter rollers 13, 14 having the same roller diameter 16, 18. Each of the counter rollers 13, 14 of the drive unit 24, 32 correspondingly drive-connected thereto can be driven with the rotational frequency attuned to the respective roller diameter 16, 18 in order to ensure an equal circumferential speed. This way, the counter rollers 13, 14 may also be designed having different roller diameters 16, 18. Accordingly, here, the second counter roller 14 has a greater roller diameter 18 relative to the first counter roller 13. Additionally, a separate control device for the drive assembly 23 may be provided for setting a rotational frequency in the respective drive unit 24, 32, which rotational frequency corresponds to the predefined circumferential speed.

As is further evident from FIG. 5, the drive assembly 23 may comprise a further drive unit 33. The further drive unit 33 is drive-connected to the forming roller 12 for also being able to subject the latter to a drive torque. This additional arrangement may be applied optionally and does not necessarily have to be provided in each of the profiling stations 2 arranged in succession. Preferably, the further drive unit 33 may be used for forming rollers 12 having a cylindrical outer circumference. This way, different circumferential speeds in the contact region with the material strip 3 to be formed can be avoided. The further drive unit 33 may also be applied in the previously described embodiment and/or designs according to FIG. 1, 2, 3, or 4.

Figure 6:
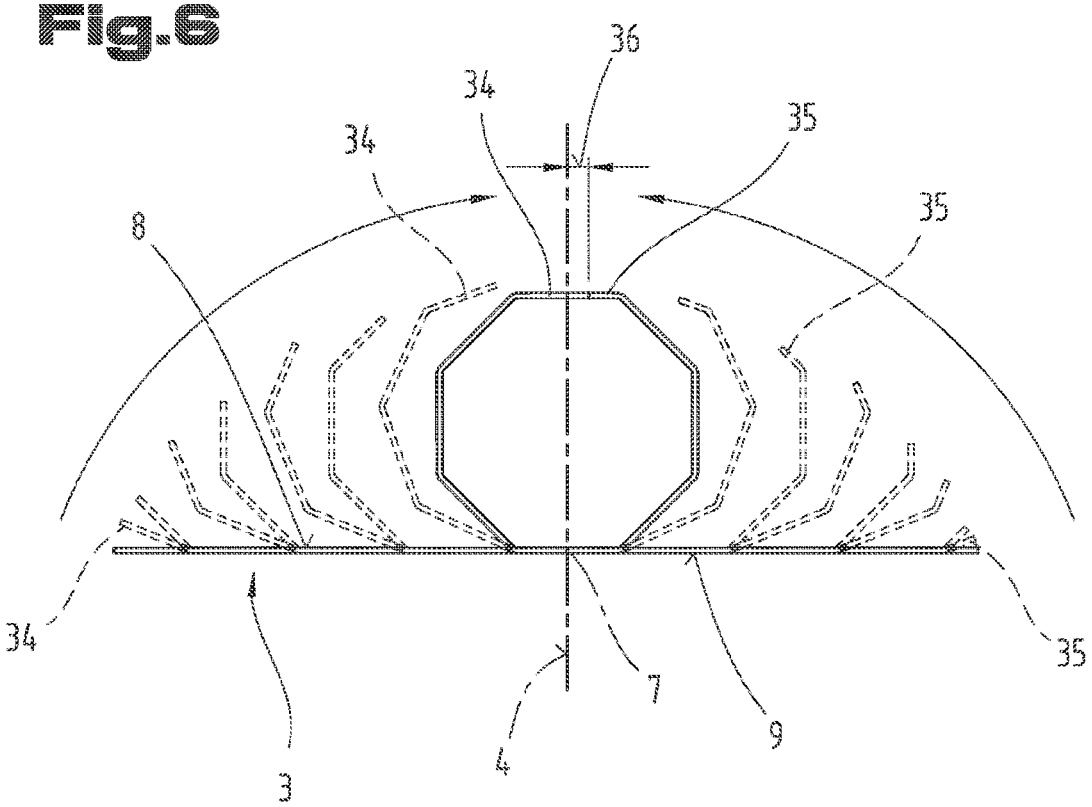
FIG. 6 an example of a profile to be produced with a hexagonal cross-section with multiple adumbrated forming stages.

FIG. 6 shows an example of a continuous forming of the material strip 3 into the profile, in the present case a hexagonal profile. In this regard, the finished cross-section is represented in full lines and the forming steps performed until then in the individual profiling stations 2 are represented in dashed lines. The depiction of the connection seam in the region of the longitudinal edges to be joined for forming the closed profile was forgone.

In the center of the profile, the central plane 4 is depicted. This exemplary embodiment additionally shows that those two partial longitudinal bands 34, 35 arranged so as to have a longitudinal extension on the edges of the material strip 3 each have a different width in a cross-sectional plane running in a normal orientation with respect to the longitudinal axis 7. In the present case, the partial longitudinal band 34 initially located to the left of the central plane 4 has a larger width than the partial longitudinal band 35 initially located on the right side. The two partial longitudinal bands 34, 35 together form one of the partial flat sides of the profile to be produced. Due to the widths of the two partial longitudinal bands 34, 35 being selected to be different from each other, the butt joint and the subsequently formed longitudinal connection region are not arranged so as to run symmetrically with respect to the central plane 4. Thus, the butt joint and the subsequently formed longitudinal connection region are arranged so as to run around an offset 36 off-center and thus laterally offset with respect to the central plane 4.

Finally, it should be noted that the previously described different rotation transmission devices 25 may be combined as desired to form the profiling installation 1.

The exemplary embodiments show possible embodiment variants, and it should be noted in this respect that the invention is not restricted to these particular illustrated embodiment variants of it, but that rather also various combinations of the individual embodiment variants are possible and that this possibility of variation owing to the teaching for technical action provided by the present invention lies within the ability of the person skilled in the art in this technical field.

The scope of protection is determined by the claims. However, the description and the drawings are to be adduced for construing the claims. Individual features or feature combinations from the different exemplary embodiments shown and described may represent independent inventive solutions. The object underlying the independent inventive solutions may be gathered from the description.

All indications regarding ranges of values in the present description are to be understood such that these also comprise random and all partial ranges from it, for example, the indication 1 to 10 is to be understood such that it comprises all partial ranges based on the lower limit 1 and the upper limit 10, i.e. all partial ranges start with a lower limit of 1 or larger and end with an upper limit of 10 or less, for example 1 through 1.7, or 3.2 through 8.1, or 5.5 through 10.

Finally, as a matter of form, it should be noted that for ease of understanding of the structure, elements are partially not depicted to scale and/or are enlarged and/or are reduced in size.

| List of reference numbers | |
|---|---|
| 1 | profiling installation |
| 2 | profiling station |
| 3 | material strip |
| 4 | central plane |
| 5 | profiling unit |
| 6 | base frame |
| 7 | longitudinal axis |
| 8 | first flat side |
| 9 | second flat side |
| 10 | rack frame |
| 11 | profiling arrangement |
| 12 | forming roller |
| 13 | first counter roller |
| 14 | second counter roller |
| 15 | first roller axis |
| 16 | first roller diameter |
| 17 | second roller axis |
| 18 | second roller diameter |
| 19 | counter roller pair |
| 20 | plane |
| 21 | buckling angle |
| 22 | bending edge |
| 23 | drive assembly |
| 24 | first drive unit |
| 25 | rotation transmission device |
| 26 | bevel gear arrangement |
| 27 | first bevel gear wheel |
| 28 | second bevel gear wheel |
| 29 | guide assembly |
| 30 | cardan joint |
| 31 | angular gearbox |
| 32 | second drive unit |
| 33 | further drive unit |
| 34 | partial longitudinal band |
| 35 | partial longitudinal band |
| 36 | offset |
| 37 | first plane |
| 38 | second plane |

The invention claimed is:

1. A profiling station for the continuous forming of a material strip into a profile, wherein the material strip has a first flat side and a second flat side that is arranged opposite the first flat side, and wherein the profiling station defines a longitudinal axis in a pass direction of the material strip, the profiling station comprising:

a rack frame, a profiling arrangement with at least one forming roller, wherein the at least one forming roller can be turned toward the first flat side of the material strip, a first counter roller, wherein the first counter roller is cylindrically designed and defines a first roller axis and a first roller diameter, a second counter roller, wherein the second counter roller is cylindrically designed and defines a second roller axis and a second roller diameter, wherein the first counter roller and the second counter roller form a counter roller pair, and the counter roller pair can be turned toward the second flat side of the material strip, and wherein the first roller axis and the second roller axis enclose a buckling angle between them, and wherein the counter rollers of the counter roller pair define between them a bending edge for the material strip to be formed, a drive assembly with at least one drive unit, wherein at least one of the counter rollers of the counter roller pair is drive-connected to the at least one drive unit, and wherein the profiling arrangement is held on the rack frame, wherein:

a mechanical rotation transmission device is provided between the first counter roller and the second counter roller, and wherein the counter roller, which is drive-connected to the first drive unit, transmits the drive torque to the other counter roller by means of the mechanical rotation transmission device, the mechanical rotation transmission device comprises a cardan joint, and the first counter roller and also the second counter roller are driven by the drive assembly and by means of the mechanical rotation transmission device such that the first counter roller at its outer circumference and the second counter roller at its outer circumference each have a circumferential speed that is equal to the other.

2. The profiling station according to claim 1, wherein the first roller diameter of the first counter roller and the second roller diameter of the second counter roller are designed to be the same size.

3. The profiling station according to claim 1, wherein the drive assembly comprises a further drive unit, and the at least one forming roller is drive-connected to the further drive unit.

4. The profiling station according to claim 1, wherein a guide assembly is provided, wherein the at least one forming roller is displaceably guided on the rack frame by the guide assembly.

5. The profiling station according to claim 1, wherein the first roller axis and second roller axis of the counter rollers of the counter roller pair are arranged in a common plane, and the common plane is arranged in a normal orientation with respect to the longitudinal axis.

6. The profiling station according to claim 1, wherein the first roller axis of the first counter roller is arranged in a first plane, and the second roller axis of the second counter roller of a counter roller pair is arranged in a second plane, and wherein the two planes are arranged so as to be parallel to and offset from each other.

7. A profiling unit for the continuous forming of a material strip into a profile, comprising multiple profiling stations arranged in immediate succession in the direction of longitudinal axis, wherein the profiling unit comprises two profiling stations arranged in immediate succession, and wherein each of the profiling stations is formed according to claim 1.

8. The profiling unit according to claim 7, wherein a base frame is provided and the two profiling stations arranged in immediate succession are arranged and held on the base frame.

9. The profiling unit according to claim 8, wherein the profiling stations arranged in immediate succession are guided on the base frame so as to be displaceable in the normal direction with respect to the longitudinal axis.

10. The profiling unit according to claim 7, wherein the profiling stations arranged in immediate succession are arranged opposite each other, with respect to a central plane running in a parallel direction with respect to the longitudinal axis, and offset from each other.

11. The profiling unit according to claim 7, wherein the profiling stations arranged in immediate succession are arranged in a mirror-imaged manner, with respect to a central plane running in a parallel direction with respect to the longitudinal axis.

12. A profiling installation for the continuous forming of a material strip into a profile, comprising multiple profiling stations arranged in immediate succession in the direction of longitudinal axis, wherein in each case two profiling stations each form multiple profiling units, and the profiling units are formed according to claim 7.

13. A profiling installation for the continuous forming of a material strip into a profile, comprising multiple profiling stations arranged in immediate succession in the direction of longitudinal axis, wherein the profiling stations are formed according to claim 1.

14. A profiling station for the continuous forming of a material strip into a profile, wherein the material strip has a first flat side and a second flat side that is arranged opposite the first flat side, and wherein the profiling station defines a longitudinal axis in a pass direction of the material strip, the profiling station comprising:

a rack frame, a profiling arrangement with at least one forming roller, wherein the at least one forming roller can be turned toward the first flat side of the material strip, a first counter roller, wherein the first counter roller is cylindrically designed and defines a first roller axis and a first roller diameter, a second counter roller, wherein the second counter roller is cylindrically designed and defines a second roller axis and a second roller diameter, wherein the first counter roller and the second counter roller form a counter roller pair, and the counter roller pair can be turned toward the second flat side of the material strip, and wherein the first roller axis and the second roller axis enclose a buckling angle between them, and wherein the counter rollers of the counter roller pair define between them a bending edge for the material strip to be formed, a drive assembly with at least one drive unit, wherein at least one of the counter rollers of the counter roller pair is drive-connected to the at least one drive unit, and wherein the profiling arrangement is held on the rack frame, wherein:

a mechanical rotation transmission device is provided between the first counter roller and the second counter roller, and wherein the counter roller, which is drive-connected to the first drive unit, transmits the drive torque to the other counter roller by means of the mechanical rotation transmission device, the mechanical rotation transmission device comprises a bevel gear arrangement having a first bevel gear wheel and a second bevel gear wheel or an angular gearbox, and the first counter roller and also the second counter roller are driven by the drive assembly and by means of the mechanical rotation transmission device such that the first counter roller at its outer circumference and the second counter roller at its outer circumference each have a circumferential speed that is equal to the other.

* * * * *